US007198023B1

(12) United States Patent
Coates

(10) Patent No.: US 7,198,023 B1
(45) Date of Patent: Apr. 3, 2007

(54) SEQUENTIAL INJECTION LUBRICATION SYSTEM FOR A SPHERICAL ROTARY VALVE INTERNAL COMBUSTION ENGINE OPERATING ON NATURAL GAS OR ALTERNATIVE FUELS

(76) Inventor: Gregory Coates, Route 34 & Ridgewood Rd., Wall, NJ (US) 07719

( * ) Notice: Subject to any disclaimer, the term of this patent is extended or adjusted under 35 U.S.C. 154(b) by 0 days.

(21) Appl. No.: 11/405,712

(22) Filed: Apr. 18, 2006

(51) Int. Cl.
*F02B 43/00* (2006.01)

(52) U.S. Cl. ..... 123/299; 123/300; 123/525

(58) Field of Classification Search ..... 123/525, 123/299, 300
See application file for complete search history.

(56) References Cited

U.S. PATENT DOCUMENTS 4,543,930 A * 10/1985 Baker ..... 123/299
4,872,433 A * 10/1989 Paul et al. ..... 123/257
4,924,828 A * 5/1990 Oppenheim ..... 123/299
5,890,459 A * 4/1999 Hedrick et al. ..... 123/27 GE

* cited by examiner

*Primary Examiner*—Noah P. Kamen
*Assistant Examiner*—Jason Benton
(74) *Attorney, Agent, or Firm*—Clifford G. Frayne

(57) ABSTRACT

A sequential injection lubrication system for a spherical rotary valve internal combustion engine operating on natural gas or alternative fuels, the lubrication system having a plurality of injectors, one for each cylinder, the injectors and communication with a lubricant reservoir and with a control unit which sequentially opens and closes the injectors for the introduction of lubricant into the cylinder, the control unit in communication with a control panel allowing the selective setting of the duration of the pulse injection and the frequency thereof.

8 Claims, 3 Drawing Sheets

SEQUENTIAL INJECTION LUBRICATION SYSTEM FOR A SPHERICAL ROTARY VALVE INTERNAL COMBUSTION ENGINE OPERATING ON NATURAL GAS OR ALTERNATIVE FUELS

BACKGROUND OF THE INVENTION

1. Field of the Invention

The present invention relates to internal combustion engines, and in particular, high compression internal combustion engines which operate on natural gas, raw natural gas, or alternative fuels such as bio-fuels, and more particularly, to a selective sequential automatic lubricating system for lubricating the cylinder and compression ring on the piston to extend the life of the engine.

2. Description of the Prior Art

Conventional internal combustion engines of the piston, cylinder and poppet valve variety are normally constructed with an oil sump and pump which lubricates all of the moving parts of the engine in order to lessen the wear and tear on the engine. The lubricating points would include, but would not be limited to, the poppet valve stems, the cylinder walls below the compression ring of the piston, and the crank shaft. Still further, the conventional internal combustion engine runs on gasoline or diesel fuel, which is a liquid, and which retains certain liquid-like properties when atomized for combustion within the combustion chamber.

The Applicant's parent has improved upon the internal combustion engine with a series of patents which eliminate the poppet valve and the moving parts associated therewith and replace the poppet valve train with a valve train of spherical rotary valves which control the intake of air and fuel into the combustion chamber and the exhaust of the spent fuel and air from the combustion chamber.

Applicant's parent has adapted his spherical rotary valve train to high compression, internal combustion engines which operate on natural gas and raw natural gas. These type of engines are oftentimes found operating at a well head, where both crude oil and raw natural gas are being pumped from the well head. The crude oil will be further refined into gasoline, diesel and other fuels, but the raw natural gas, prior to environmental concerns would normally be burnt off at the well head. In most jurisdictions the burning off of the raw natural gas has become prohibited and another means of disposing of the raw natural gas must be found. One solution was to position a high compression engine proximate the well head and to burn the raw natural gas in the internal combustion engine, which engine in turn would be used to drive a pump or a generator and develop electricity which would be sold to the local electrical grid. Engines of this type would normally operate around the clock and suffer extensive wear and tear from the high heat of combustion and acidity of the raw natural gas such that the life expectancy of their components was only a few months. The wear and tear is contributed by the fact that the raw natural gas is a very dry, acidic fuel which burns at a very high temperature and under high compression such that normal poppet valves would quickly become scorched and brittle and the compression ring on the piston would also become scorched and brittle affecting the compression of the respective cylinder and affecting the integrity of the surface of the cylinder bore.

The adaption of the Applicant's parent spherical rotary valve system to these engines has solved the problem with the scorching of the poppet valves by eliminating them. However, the compression ring on the pistons were still being affected by the high temperature and high compression of the raw, acidic natural gas fuel, such that the scorching and degradation of the internal cylinder wall was still occurring.

The sequential, intermittent lubricating system of the present invention for providing lubrication to the cylinder, and more particularly to the compression ring, solves the problem of scorching and significantly extends the life expectancy of such an engine, whether it be an industrial engine or a vehicle engine running on natural gas, hydrogen, or alternative fuels.

OBJECTS OF THE INVENTION

An object of the present invention is to provide for a novel intermittent sequential lubricating system for supplying selected lubrication to the cylinder, and more particularly to the compression ring of an internal combustion engine operating on natural gas or alternative fuels such as bio-fuels.

Another object of the present invention is to provide a novel apparatus for allowing a user to program the intermittent sequential lubrication system as needed for the internal combustion engine operating on natural gas or alternative fuels, such as bio fuels.

A still further object of the present invention is to provide for a novel intermittent sequential lubrication system which delivers the precise amount of lubrication required in the precise sequence to the combustion chamber of an internal combustion engine operating on natural gas or alternative fuels such as bio-fuels.

SUMMARY OF THE INVENTION

A sequential injection lubrication system for a spherical rotary valve internal combustion engine operating on natural gas or alternative fuels, the lubrication system having a plurality of injectors, one for each cylinder, the injectors and communication with a lubricant reservoir and with a control unit which sequentially opens and closes the injectors for the introduction of lubricant into the cylinder, the control unit in communication with a control panel allowing the selective setting of the duration of the pulse injection and the frequency thereof.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
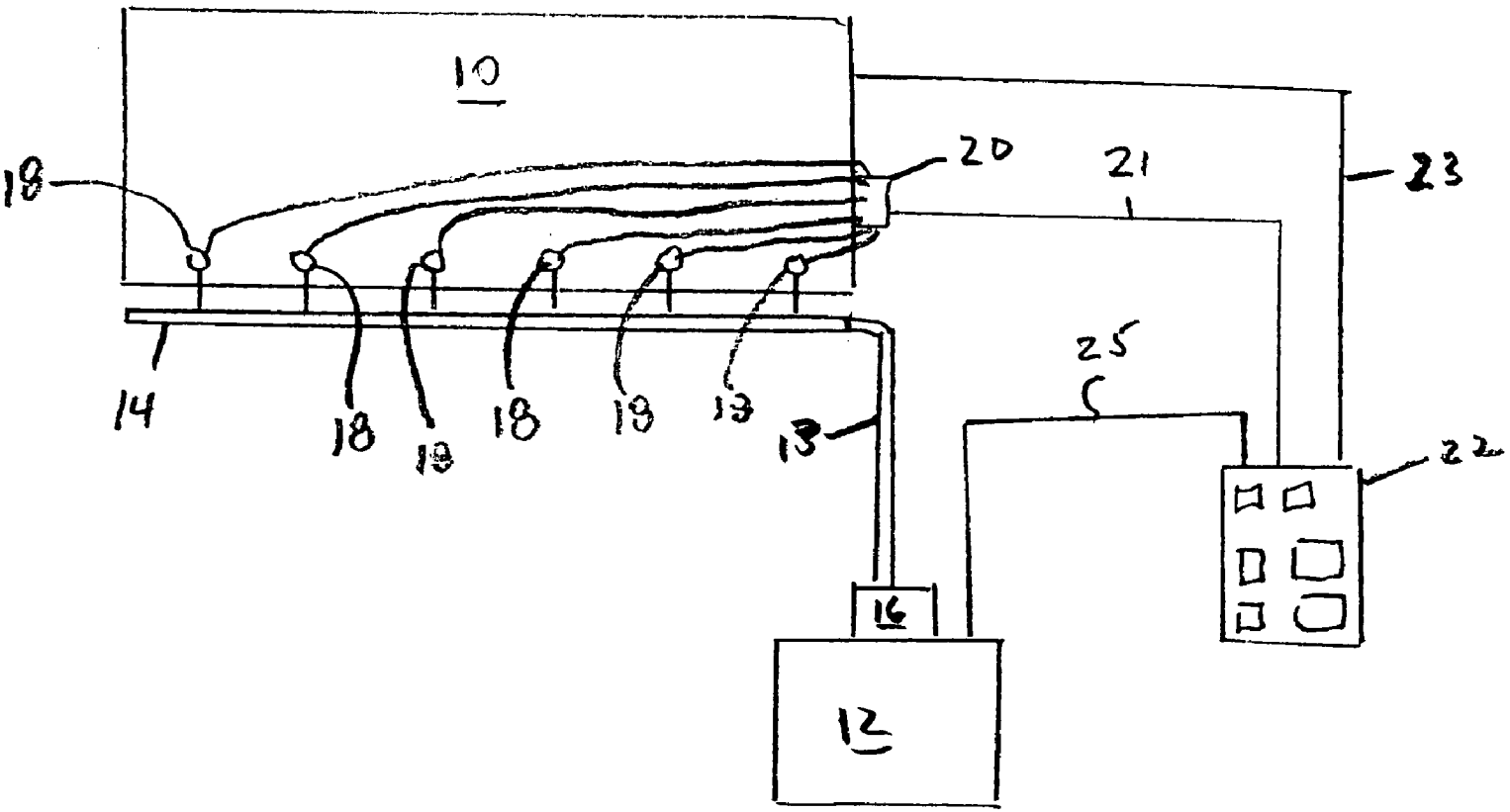
FIG. 1 is a schematic of the lubrication system of the present invention.

FIG. 1 is a schematic of the lubrication system of the present invention. For purposes of example, the engine will be described as a straight six diesel engine 10 being fueled by natural gas, but it will be understood that alternative fuels, such as bio-fuels, may also fuel the engine. In the instant situation, the engine 10 is being used to run a generator (not shown) which in turn generates electricity which is sold to the local electrical grid. A lubricant reservoir 12 is in communication 13 with a high pressure lubricant rail 14 by means of pump 16 thereby insuring that the lubricant rail is filled with lubricant. The lubricant rail 14 in turn is in communication with a plurality of injectors 18, there being at least one injector 18 for each cylinder of the engine 10. The injectors in turn are in communication with a sequential injection control unit 20 which in turn is in communication 21 with an operation panel 22. The operation panel 22 can be either set manually or remotely by means such as radio frequency. The operation panel is set to control the timing gap or pulse between the opening and closing of the injectors 18 and can also set the time interval between pulses, thereby controlling the amount of lubricant which is injected into each of the cylinders sequentially.

The operation panel 22 is also connected 23 to sensors on the engine which allows the user/operator to monitor the condition and operation of the engine 10 and to adjust the time gap between pulses and the length of the pulse, thereby controlling lubricant injection into the cylinders. The operation panel may also be in communication 25 with the reservoir 12 and pump 16 to monitor the operation and volume thereof.

Figure 2:
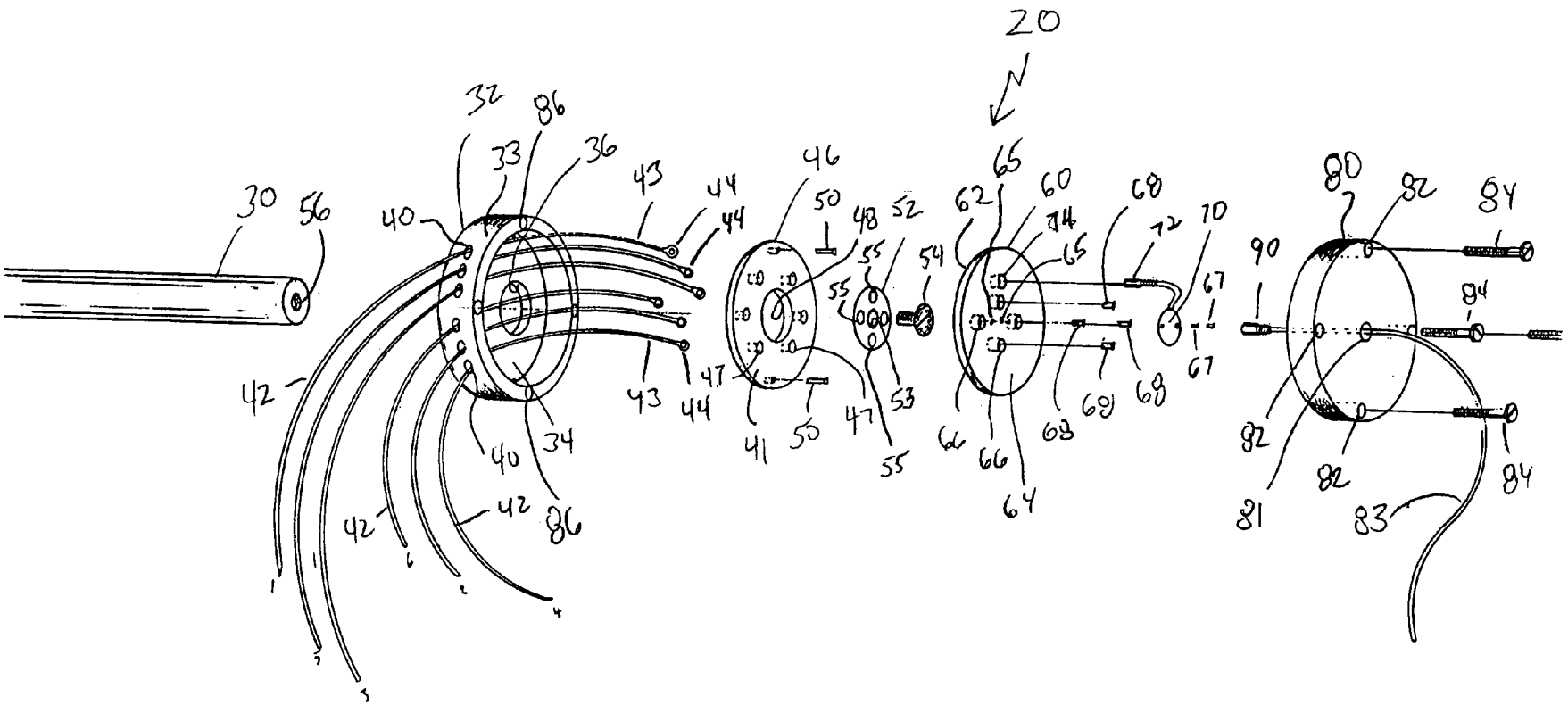
FIG. 2 is an exploded perspective view of the sequential injection unit.
Figure 3:
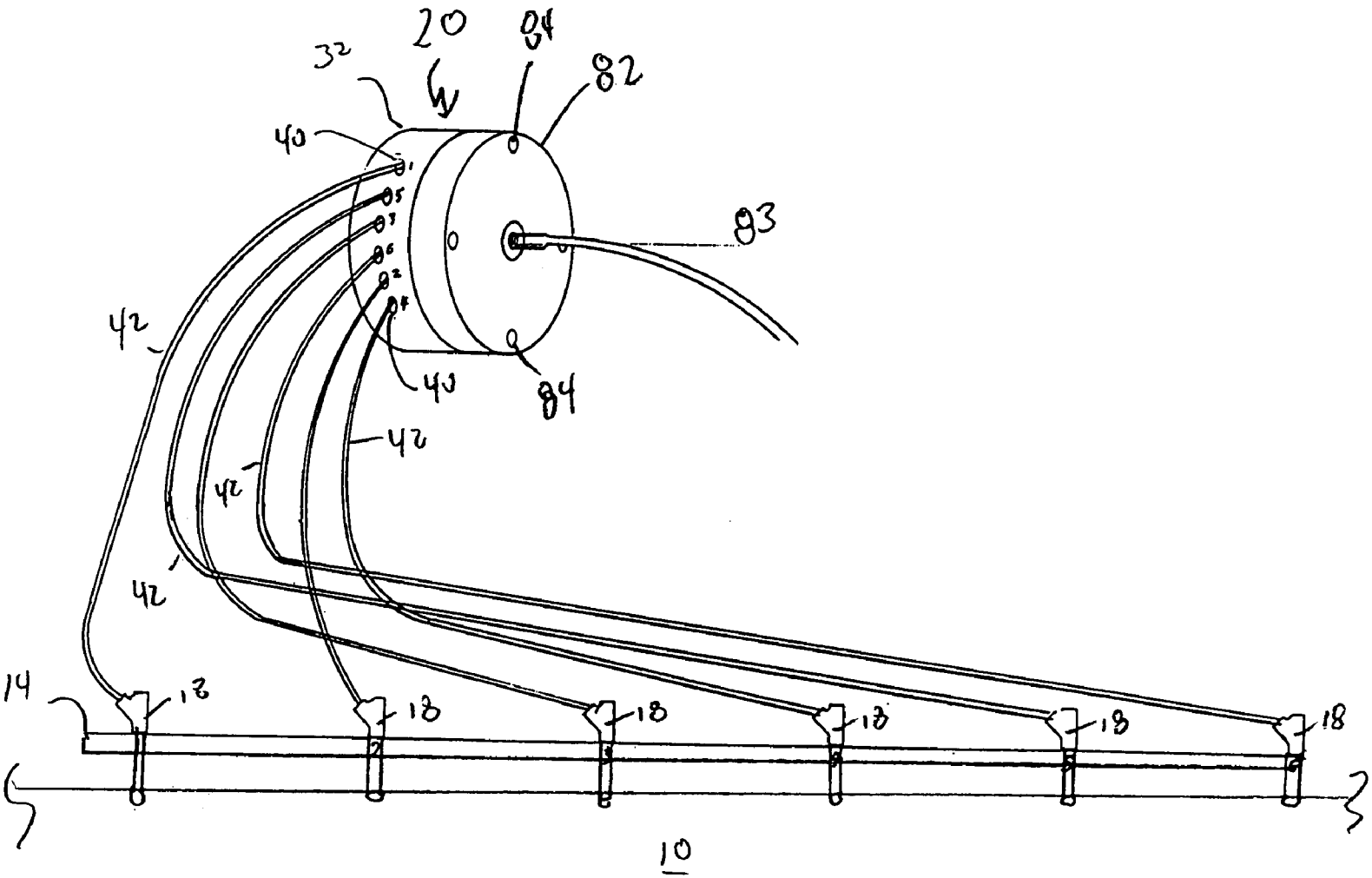
FIG. 3 is a perspective assembled view of the sequential injection unit.

FIG. 2 is an exploded view of the sequential injection control unit 20, and FIG. 3 is an assembled view. The control unit 20 is mounted to the engine 10 allowing an extension of the rotating shaft 30 upon which the rotating spherical intake valves are mounted to enter the control unit 20. This shaft is extended through the head of the engine 10, journaled and sealed.

Mounted to engine 10 and about rotating shaft 30 is a stationary housing 32 generally circular in cross section defined by a base wall 34 having an aperture 36 there through for passage of the rotating shaft 30, and a cylindrical side wall 33 having a plurality of apertures 40 for the passage there through of a plurality of distribution wires 42 having a contact connector 44 at their respective ends 43 which contact connectors will be enclosed within the stationary housing 32.

A fixed, non-conductive contact plate 46 again generally circular in cross sectional area having a central aperture 48 for passage of the rotating shaft 30 is positioned within stationary housing 32 and the contact connectors 44 of the distribution wires 42 are secured at discrete locations to the front face 41 contact plate 46 via apertures 47 such that they can be contacted by a rotating brush member as described more fully hereafter.

The fixed non-conductive contact plate 46 is secured to the rear wall 34 of housing 32 by means of threaded fasteners 50. The contact plate 46 with the secured distribution wires 42 and contact connectors 44 is positioned such that shaft 30 extends through aperture 48. A lock washer 52 having a central aperture 53 and threaded fastener 54 passing through aperture 53, engages a threaded bore 56 in the end of the rotating shaft 30, lock washer 52 having a plurality of circumferential apertures 55 for receipt of a fastening means.

Juxtaposed fixed non-conductive contact plate 46 is non-conductive rotating plate 60 which is secured to lock washer 52 by means of fasteners 68 passing through apertures 66 and cooperative with circumferential apertures 55 and hence to the rotating shaft 30. A first side 62 of rotating plate 60 is positioned distal proximate the front face 41 of fixed non-conductive contact plate 46. The opposing side 64 of the rotating plate 60 is formed with bores 65 to receive fasteners 67 in order to secure a permanent fixed contact 70 having a spring loaded contact rotating brush 72 secured thereto, which rotating brush 72 passes through aperture 74 in non-conductive rotating plate 60.

A fixed cap 80 having a plurality of apertures 82 for receipt of fastener means 84 and secured to housing 32 by means of complimentary bores 86 positioned about circumferential side wall 33. Cap 80 contains a central aperture 81 for receipt of an electrical connector 83 having a second brush means 90 positioned on its end, second brush means 90 in communication with permanent fixed contact 70, second brush 90 in electrical communication with the operating panel 22 so as to provide a source of current to permanent fixed contact 70 and hence rotating brush 72 which in turn through rotation as being secured to lock washer 52, sequentially comes into communication with contact connectors 44 which are fixed and in communication with the injectors 18 by means of the distribution wires 42.

FIG. 3 illustrates the sequential injection control unit 20 in assembled form with distribution wires 42 emanating there from and in communication with the injectors 18 which communicate with pressurized lubricating rail 14.

In this configuration, the source of electrical power is in communication with second brush 90 which in turn is in communication with fixed contact 70 which is in contact with rotating brush 72. Rotating brush 72 sequentially contacts the contact connectors of 44 transferring power down the distribution wires 42 to the injectors, sequentially firing the injectors, and allowing the injection of a lubricant into the respective cylinder for a predetermined amount of time.

The present invention has been described with respect to a straight six internal combustion engine with spherical rotary valve assembly, which would require six distribution wires, one for each cylinder. It will be recognized by those of ordinary skill in the art that the present invention is not limited to six cylinder engines, but is adaptable to any single or multiple cylinder engine with spherical rotary valve assembly, the only divergence being the number of distribution wires and contact connectors required for the number of cylinders in the engine.

The lubricant can be any liquid combustible fuel such as gasoline, diesel or biodiesel, or their equivalents. The operating panel 22 can be set manually or by radio frequency or the equivalent. It can set the gap between pulses to be set as lower as milliseconds and to set the duration of the pulse, e.g. the injection time period from milliseconds to constant. The optimum injection timing would be in the range of plus or minus 20 degrees before top dead center on the induction stroke of the internal combustion engine.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A sequential injection lubrication system for a spherical rotary valve internal combustion engine operating on natural gas or alternative fuels, the sequential injection lubrication system comprising:

a lubricant rail in communication with a lubricant reservoir, said rail in communication with a plurality of lubricant injectors, each of said plurality of lubricant injectors in communication with a cylinder of an internal combustion engine having spherical rotary valves and operating on natural gas or alternative fuels;

an injection control unit mounted to said internal combustion engine, said injection control unit having a plurality of fixed contact points mounted therein, each of said fixed contact points corresponding to and in electrical communication means with one of said plurality of injectors, said injector control unit having a rotating plate juxtaposed said fixed contact point, said rotating plate having a conductive brush mounted thereto for sequential rotational contact with said fixed contact points;

a control panel in communication with a source of electrical energy and in communication with said conductive brush, said control panel controlling the flow of energy to said conductive brush, and controlling the opening and closing of said plurality of injectors and the introduction of said lubricant into the respective cylinder of said internal combustion engine and the frequency of said opening and closing of said injectors.

2. The sequential injection lubrication system for a spherical rotary valve internal combustion engine operating on natural gas or alternative fuels in accordance with claim 1, wherein said injection control unit comprises:

a fixed non-conductive housing mounted to said internal combustion engine, said fixed non-conductive housing having a circular rear wall having an aperture there through for passage of an extension of a rotational shaft member, said shaft member having mounted thereon spherical rotary valves for controlling the intake and exhaust of said internal combustion engine, said rotational shaft member having a longitudinal threaded bore in its extension, said fixed non-conductive housing having a circumferential side wall having a plurality of openings there through for passage there through of each of said electrical communication means from said fixed contact points to said injectors;

a fixed non-conductive plate mounted and secured in said fixed non-conductive housing, said fixed non-conductive plate having a plurality of throughbores for the passage and fixedly positioning of said fixed contact points on a first face of said fixed plate;

a lock washer having a central aperture and a plurality of radially spaced apertures proximate its periphery;

a threaded fastener securing said lock washer to said rotational shaft member;

a rotatable non-conductive plate member having a first side and a second side, said rotational non-conductive plate member having a plurality of apertures for passage there through of a securing means, said securing means securing said rotational non-conductive plate member to said lock washer, said rotational non-conductive plate member having a brush aperture extending from said first side to said second side for passage and securing of an electrical contact brush on said first side of said rotational non-conductive plate member, said electrical contact brush in selective sequential rotational contact with said fixed contact points;

a non-conductive cap member secured to said non-conductive housing member, said non-conductive cap member having an aperture there through for passage of an electrical communication means in communication with said electrical contact brush and said control panel and said source of electrical power.

3. The sequential injection lubrication system for a spherical rotary valve internal combustion engine in accordance with claim 1, wherein said fuel is natural gas.

4. The sequential injection lubrication system for a spherical rotary valve internal combustion engine in accordance with claim 1, wherein said fuel comprises bio fuel.

5. The sequential injection lubrication system for a spherical rotary valve internal combustion engine in accordance with claim 1, wherein said fuel comprises an alternative fuel.

6. The sequential injection lubrication system for a spherical rotary valve internal combustion engine in accordance with claim 1, wherein said lubricant comprises gasoline.

7. The sequential injection lubrication system for a spherical rotary valve internal combustion engine in accordance with claim 1, wherein said lubricant comprises diesel fuel.

8. The sequential injection lubrication system for a spherical rotary valve internal combustion engine in accordance with claim 1, wherein said lubricant comprises bio fuel.

* * * * *